US008024872B2

(12) United States Patent
Pettis

(10) Patent No.: US 8,024,872 B2
(45) Date of Patent: Sep. 27, 2011

(54) SHOE SOLE PROTECTOR

(76) Inventor: Raymond Anthony Pettis, Woodbridge, VA (US)

( * ) Notice: Subject to any disclaimer, the term of this patent is extended or adjusted under 35 U.S.C. 154(b) by 934 days.

(21) Appl. No.: 12/007,121

(22) Filed: Jan. 7, 2008

(65) Prior Publication Data

US 2008/0163518 A1 Jul. 10, 2008

Related U.S. Application Data

(60) Provisional application No. 60/878,699, filed on Jan. 5, 2007.

(51) Int. Cl.
*A43C 13/00* (2006.01)

(52) U.S. Cl. ..... 36/73; 36/135; 36/15; 36/132; 36/59 R

(58) Field of Classification Search ..... 36/15, 135, 36/73, 132, 59 R
See application file for complete search history.

(56) References Cited

U.S. PATENT DOCUMENTS

| | | | | |
|---|---|---|---|---|
| 1,481,698 | A | 1/1824 | Edwards | |
| 1,662,756 | A | 3/1828 | Montante | |
| 65,247 | A * | 5/1867 | Loveland | 36/15 |
| 1,701,611 | A * | 2/1929 | Glidden et al. | 36/32 R |
| 2,134,196 | A * | 10/1938 | Miller | 36/72 C |
| 2,312,841 | A * | 3/1943 | Lewis | 36/30 R |
| 3,337,770 | A | 8/1967 | Saraceni et al. | |
| 3,538,628 | A * | 11/1970 | Einstein, Jr. | 36/15 |
| 3,605,291 | A | 9/1971 | Moore et al. | |
| 3,693,269 | A * | 9/1972 | Guarrera | 36/15 |
| 3,808,712 | A | 5/1974 | Elliott | |
| 3,845,576 | A | 11/1974 | Howland, Jr. | |
| 3,903,557 | A | 9/1975 | Howland, Jr. | |
| 3,903,620 | A * | 9/1975 | Gillet | 36/25 R |
| 4,258,483 | A * | 3/1981 | Hogue | 36/135 |
| 4,301,604 | A * | 11/1981 | Hamilton | 36/130 |
| 4,387,515 | A * | 6/1983 | Baldwin | 36/7.5 |
| 5,315,767 | A | 5/1994 | Bradbury | |
| 5,694,704 | A | 12/1997 | Kasbrick | |
| 5,771,605 | A | 6/1998 | Safdie | |
| 5,845,416 | A | 12/1998 | Hands | |
| 5,907,881 | A | 6/1999 | Safdie | |
| 6,032,386 | A * | 3/2000 | Evans | 36/15 |
| 6,055,748 | A | 5/2000 | Harrison | |
| 6,058,627 | A * | 5/2000 | Violette et al. | 36/61 |
| 6,584,704 | B2 | 7/2003 | March | |
| 6,684,442 | B1 * | 2/2004 | Parker et al. | 12/146 B |

(Continued)

FOREIGN PATENT DOCUMENTS

| | | |
|---|---|---|
| JP | 10-108710 | 4/1998 |

*Primary Examiner* — Ted Kavanaugh
(74) *Attorney, Agent, or Firm* — Diederiks & Whitelaw, PLC

(57) ABSTRACT

A multi-layered protector is adapted to attach to and cover the entire sole of a shoe to protect the sole from being marred or otherwise damaged when the shoe is worn by a user. The protector includes a ground engaging layer, a wear indicating layer and an adhesive layer. The wear indicating layer is rigid in character and provides immediate feedback to a user of its exposure. A removable peel layer adjacent the adhesive layer may be removed in order to attach the sole protector to the sole of the shoe. Preferably, the ground engaging layer includes an upwardly extending, peripheral rim portion adapted to protect the outer edge portions of the sole. A deformable conforming layer is optionally provided between the wear indicating layer and the adhesive layer. The protector may be adapted for customization or may be produced specifically for use with a particular shoe.

10 Claims, 3 Drawing Sheets

U.S. PATENT DOCUMENTS

| | | | | |
|---|---|---|---|---|
| 6,948,261 | B1 | 9/2005 | Grasso | |
| 7,377,054 | B2 * | 5/2008 | Milner et al. | 36/15 |
| 2002/0178620 | A1 * | 12/2002 | Asciolla | 36/132 |
| 2003/0159314 | A1 * | 8/2003 | Lewia | 36/130 |
| 2008/0222915 | A1 * | 9/2008 | Viar et al. | 36/7.5 |

* cited by examiner

SHOE SOLE PROTECTOR

CROSS-REFERENCE TO RELATED APPLICATION

The present application claims the benefit of U.S. Provisional Patent Application Ser. No. 60/878,699 entitled "Shoe Sole Protector" filed Jan. 5, 2007.

BACKGROUND OF THE INVENTION

1. Field of the Invention

The present invention pertains to the art of footwear and, more particularly, to a protective covering which is adapted to be removably attached to the sole of a shoe to preserve the sole from marring or other deteriorating damage while the shoe is worn.

2. Discussion of the Prior Art

Collecting items which are expected to increase in value over time is commonplace. Perhaps most common is the collecting of stamps and coins. However, various other collectibles are becoming widespread, including certain dolls, baskets and even shoes. True collectors value their investments and preserve the collected items to prevent any depreciation. For instance, stamps are typically retained in transparent sleeves and not directly touched by human hands, while dolls are maintained in glass or other display containers to avoid collecting dust. Both of these storage arrangements allow the items to be viewed and appreciated, yet assures the items are well protected from various, potentially deteriorating effects.

In the case of shoes, it is now common for manufacturers to run limited edition shoe lines, much like many high priced automobiles. These shoes, which include sneakers, are high-priced and in great demand. Many people have learned that purchasing such shoes, retaining them for a certain period of time, and then selling the shoes can result in a significant return on the initial investment. However, the value of the shoes drops dramatically if the shoe is marred or otherwise damaged from its original form. Therefore, investors in this area generally retain the purchased shoes in packaging until the time for resale, thereby assuring that the original quality of the shoe remains intact.

Whether it is the original or a subsequent purchaser of collectible shoes, the shoes, at some point, are obtained for the purpose of wearing them. Just as a rich and famous woman might experience wearing a designer dress to a party or award ceremony, it is desired by many to obtain and wear collectible shoes to various events. In the past, the decision to wear a pair of collectible shoes was done at the price of severe depreciation of the shoes. Mainly, the soles of the shoes would become dirty and worn. Even a single use of the shoes in such a common fashion could result in the increased value of the shoes being completely lost. Realizing the class of people who purchase such shoes, simply stepping in gum, oil or other substances can deteriorate the shoe sole to the point where the owner may never wish to wear the shoe again.

Various protective attachments for shoes have been proposed, including peel and stick plastic films which are adapted to be removably secured to the soles of the shoes in order to prevent direct contact between the soles and the ground surface. Unfortunately, the plastic film-type attachments are simply not desirable, mainly due to the slippery nature of the material and/or the ease in which the material can be ripped, resulting in scuffing of the sole. Another previously proposed attachment employed a non-skid surface material to minimize the chance of accidental injury due to slipping. In general, the non-skid surface material was coated with an adhesive to enable the protective attachment to be removably attached to a shoe sole. Although advantageous in certain ways, this known protective attachment also suffered a common drawback in that a tear or wearing out of even a small section of the attachment directly exposed the shoe sole to irreparable damage. Examples of such prior known arrangements are represented by U.S. Pat. Nos. 2,134,196 and 3,903,620, respectively.

Based on the above, there still exists a need for a shoe sole protector which can be readily attached to and removed from the sole of a shoe, which provides enhanced traction and assures that the sole of the shoe will not be marred due to unforeseen damage to a surface engaging layer of the protector. More specifically, there exists a need for a shoe sole protector which effectively provides a user with timely feedback in connection with any damage to the surface engaging layer of the protector, while assuring that the sole of the shoe is still appropriately protected.

SUMMARY OF THE INVENTION

The present invention is directed to a multi-layer shoe sole protector which is adapted to be readily, removably attached to the sole of a shoe for protecting the sole from being marred or otherwise damaged when the shoe is worn by a user. In accordance with a preferred embodiment of the invention, the shoe sole protector includes a lowermost, ground engaging layer, a wear indicating layer and an adhesive layer. The ground engaging layer is attached directly to one side of the wear indicating layer which, in turn, has an opposing side provided with the adhesive layer. A peel layer is provided atop the adhesive layer, with the peel layer being removable to expose the adhesive layer in order to attach the sole protector to the bottom of a shoe. In another embodiment of the invention, a conforming layer is provided between the wear indicating layer and the adhesive layer. Therefore, in accordance with this embodiment, the adhesive layer is provided on one side of the conforming layer for attachment to the sole. In general, the conforming layer is deformable to advantageously enable the protector to follow the varying contours of the shoe sole, thereby assuring a more seamless, aesthetically pleasing and enhanced attachment.

The ground engaging layer is preferably constituted by a soft, elastomeric material having a traction or tread configuration designed to establish a firm, yet cushioned, ground engagement surface. The wear indicating layer is preferably constituted by a more rigid, preferably plastic, material. Finally, the adhesive layer provides a tacky surface for selective, removable attachment of the protector to the shoe sole. When employed, the conforming layer is formed from a soft, pliable rubber or plastic material.

In accordance with the most preferred form of the invention, the shoe sole protector of the invention is produced during production of, or at least specifically for, the shoe to which it is designed to be attached so as to establish a custom fit. Most preferably, at least the ground engaging layer includes an upwardly extending, peripheral rim portion which has adhesive provided directly thereon. With this arrangement, when the protector is attached to the shoe sole, the peripheral rim portion extends slightly up and around the sole, while being attached to be side of the sole for added protection.

The protector of the invention is intended to be sold either with the shoe for which it is designed, or as an aftermarket product that has been trimmed for a custom fit. In any case, when the peel layer is removed and the protector is adhesively attached to the sole of the shoe, the shoe can be worn without fear of the sole being marred or otherwise damaged. More specifically, during use, the ground engaging portion will abut the ground surface, rather than the sole of the shoe. The cushioned material used for the ground engaging portion will assure a comfortable and pleasant feel to the user. Particularly important in connection with the invention is the fact that, even if the ground engaging portion should become damaged, at most, the wear indicating layer will be exposed. The hard, rigid characteristics of this layer will provide immediate feedback to the user of its exposure and assure that the sole is fully protected.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
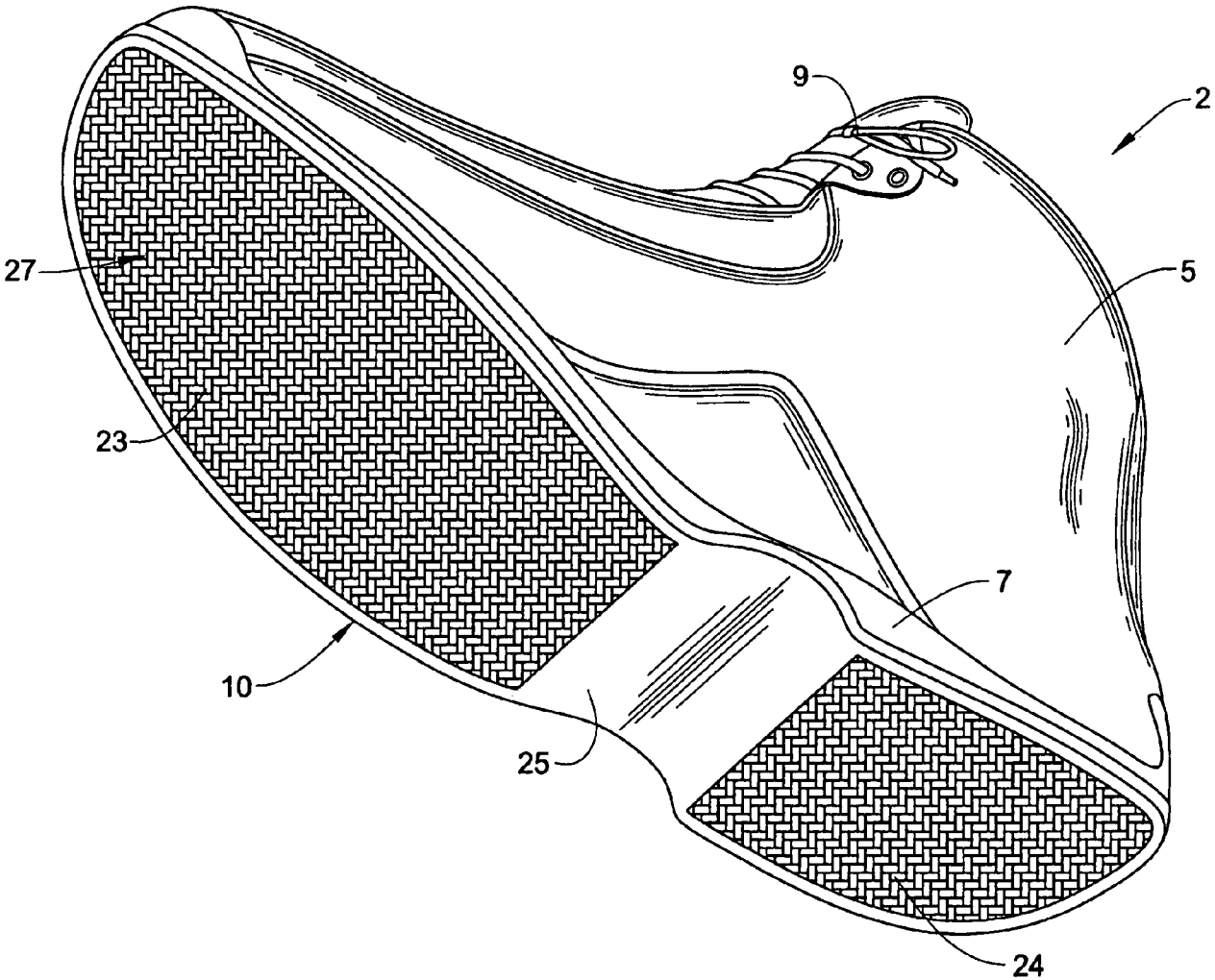
FIG. 1 is a lower perspective view of a shoe having attached thereto a sole protector constructed in accordance with the invention.

With initial reference to FIG. 1, a shoe 2 is shown to include an upper 5 and a sole 7. As will become more fully evident below, shoe 2 can take various forms in connection with the invention, including a sneaker having laces 9 or a dress shoe. Of particular interest is the inclusion of a protector 10 which extends along and is secured to sole 7. As will become more fully evident below, protector 10 is adapted to be readily, removably attached to sole 7 of shoe 2 for protecting sole 7 from being marred or otherwise damaged when shoe 2 is worn by a user.

Figure 2:
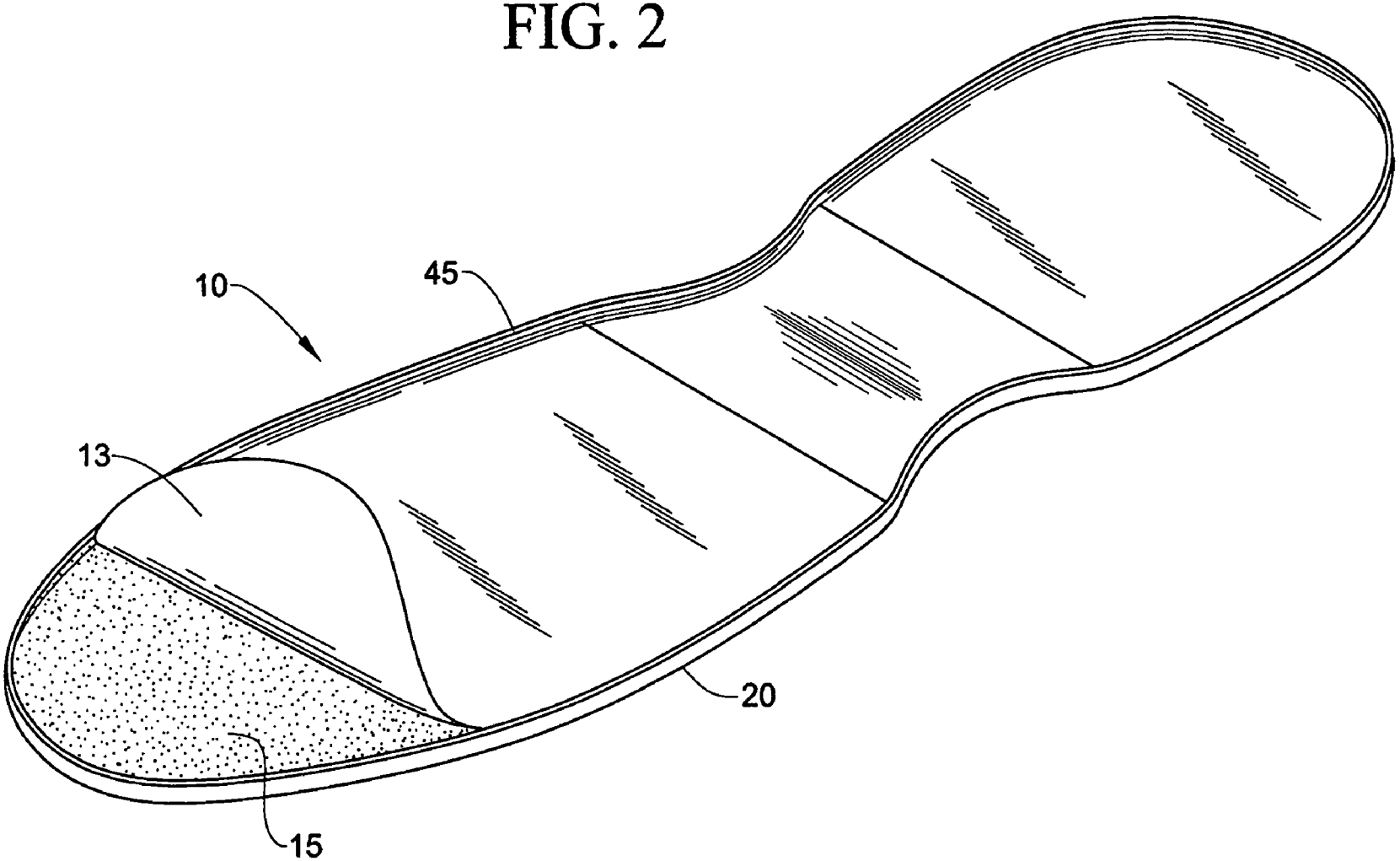
FIG. 2 is an upper perspective view of the sole protector of FIG. 1.

FIG. 2 shows protector 10 prior to attachment to shoe 2. For attachment purposes, protector 10 includes a peel layer 13 which exposes an adhesive layer 15. As will be described more fully below, protector 10 is specifically configured to conform to sole 7 of shoe 2. To this end, shoe sole protector 10 of the invention can be produced during production of shoe 2 utilizing a mold based on the size of the mold used for sole 7. In the alternative, protector 10 can be sold as an aftermarket product, such as in the form of a rectangular, oval or other configured block upon which sole 7 can be traced, with a custom fit protector 10 then being formed by cutting out the traced design. In any case, protector 10 of the invention is designed to be attached so as to establish a custom fit, with protector 10 either being made with shoe 2 for which it is designed, or as an aftermarket product that has been trimmed for a custom fit. Therefore, when peel layer 13 is removed, protector 10 can be stuck to sole 7 through the use of adhesive layer 15 to enable shoe 2 to be worn without the fear of sole 7 being marred or otherwise damaged.

Figure 3:
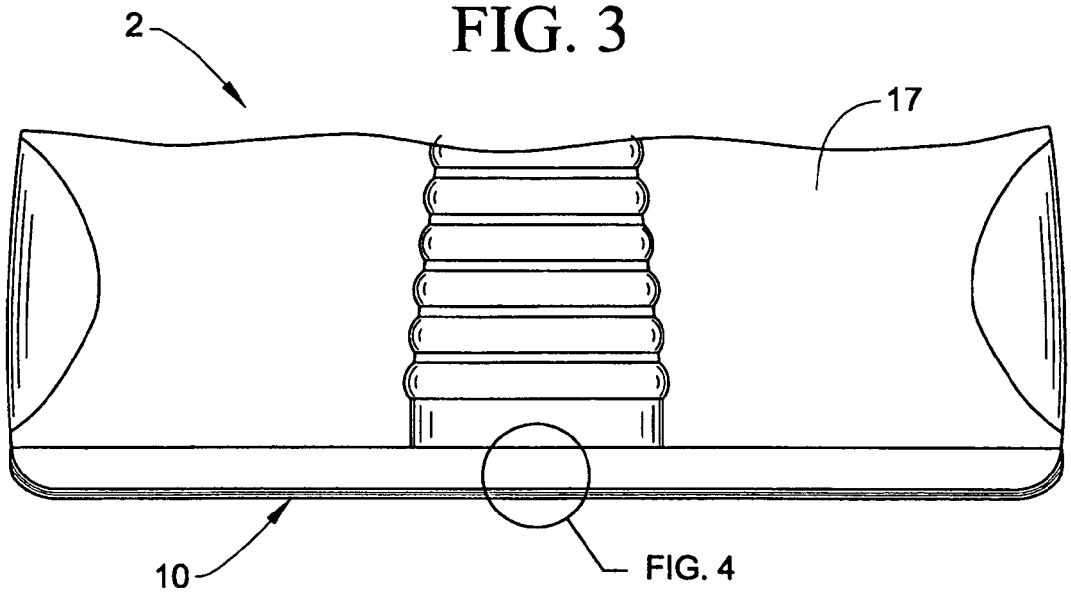
FIG. 3 is a rear elevational view of the shoe and sole protector arrangement of FIG. 1.
Figure 4:
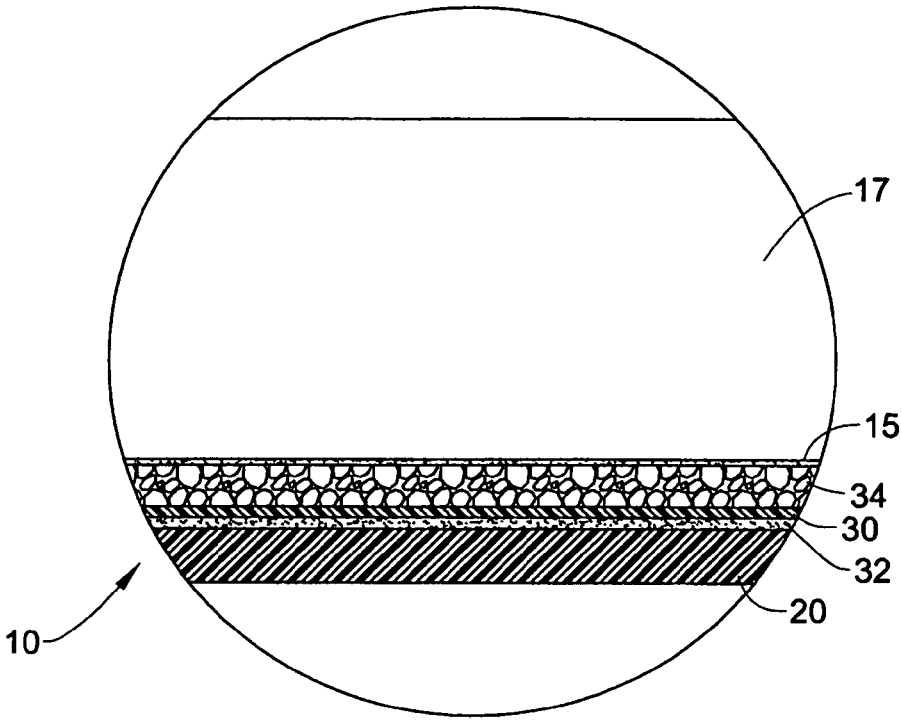
FIG. 4 is a magnified view of a portion of the shoe and sole protector of FIG. 3, with the sole protector shown in cross-section.

Reference will be made below to FIGS. 3 and 4 in further detailing the construction of a preferred embodiment of protector 10, with FIG. 3 illustrating a back portion 17 of shoe 2 and FIG. 4 illustrating an enlarged portion of FIG. 3, particularly showing protector 10 in cross-section. As shown, protector 10 includes a ground engaging layer 20. Prior to providing further details of protector 10 with reference to FIGS. 3 and 4, FIG. 1 best illustrates that ground engaging layer 20 includes a front portion 23, rear portion 24 and an intermediate portion 25. In this embodiment, front portion 23 and rear portion 24 are provided with treads 27 which establish a traction surface, the particular design of which can widely vary in the accordance with the invention. In the preferred form of the invention, ground engaging layer 20 is constituted by a soft, elastomeric material that establishes a firm, yet cushioned ground engaging surface. In the most preferred form, ground engaging layer 20 is constituted by clear matte-finished polyvinyl chloride (PVC) having a thickness of about 19 mils. Based on the construction of sole 7, intermediate portion 23 extends upward out of a plane generally defined by front and rear portions 23 and 24.

Referring back to FIGS. 3 and 4, important in connection with the present invention is the inclusion of an intermediate or a wear indicating layer 30 of protector 10. Wear indicating layer 30 is constituted by a rather rigid, hard material, such as a flexible plastic. Preferably, wear indicating layer 30 is constituted by clear vinyl. Wear indicating layer 30 includes one side surface that is bonded or otherwise fixedly formed with ground engaging layer 20. In a preferred embodiment, wear indicating layer 30 is adhered to ground engaging layer 20 with a clear acrylic pressure sensitive adhesive layer 32. On an opposing side surface, protector 10 includes an optional conforming layer 34 upon which adhesive layer 15 is provided. In one preferred embodiment, adhesive layer 15 is constituted by a clear permanent acrylic adhesive, while conforming layer 34 is formed from a soft, pliable rubber or plastic, almost foam-like, material.

At this point, it should be recognized that conforming layer 34 is optionally provided. It is considered that conforming layer 34 is particularly advantageous in connection with the use of protector 10 on a shoe 2 having a sole 7 provided with a rather undulating ground engaging surface. In such cases, conforming layer 34 deforms, thereby enabling protector 10 to effectively follow the contour of sole 7. On the other hand, if sole 7 has a rather smooth lower surface, conforming layer 34 is preferably not provided in order to minimize the overall thickness of protector 10. It should be readily understood that, if conforming layer 34 is not present, adhesive layer 15 is provided directly on wear indicating layer 30. That is, although conforming layer 34 can be directly adhered during manufacturing to wear indicating layer 30, adhesive layer 15 is still employed to removably secure protector 10 to sole 7.

With respect to the dimensions of protector 10, again it should be realized that each protector 10 is individually designed to establish a custom fit with a particular shoe 2 in which it is employed. Therefore, the overall length, width and peripheral design of protector 10 will greatly vary depending on the overall configuration of shoe 2. However, with respect to the various layers of protector 10, the most preferred embodiment of the present invention does not have the overall height or thickness of protector 10 exceeding approximately 22-36 mils when conforming layer 34 is not employed, and approximately 32-56 mils, when conforming layer 34 is employed. In connection with these thicknesses, ground engaging layer 20 is preferably in the order of 14-24 mils, most preferably about 19 mils, and the intermediate or wear indicating layer 30 is less than or equal to 6 mm, most preferably about 4 mils. Adhesive layer 32 is preferably about 4 mils in thickness or less, while adhesive layer 15 is relatively thin, preferably about 2 mils. It should also be realized that, even in the embodiments wherein conforming layer 34 is employed, once protector 10 is firmly pressed against and secured to sole 7, the overall thickness of protector 10 will be reduced based on compression.

When formed in accordance with the preferred embodiment of the invention shown in FIG. 2, protector 10 is adapted to be attached to sole 7 by first removing peel layer 13 and exposing adhesive layer 15. Protector 10 can then be properly positioned upon sole 7 and firmly attached through adhesive layer 15. Once protector 10 is properly attached, shoe 2 can be worn without fear of sole 7 being marred or otherwise damaged. More specifically, during use, ground engaging layer 20 will abut the ground surface, rather than sole 7 of shoe 2. The cushioning material employed in connection with ground engaging layer 20, as well as the embodiments employing conforming layer 34, will assure a comfortable and pleasant feel to the user. Although protector 10 preferably employs only a tacky adhesive in connection with adhesive layer 15 such that protector 10 is disposable and designed for a one-time use only, it is still considered particularly important in connection with the present invention that wear indicating layer 30 is provided to assure that sole 7 cannot be irreparably damaged upon ground engaging layer 20 being torn or worn during use. For example, if a user was to slide on a piece of glass, the glass may potentially slice ground engaging layer 20 but, due to the hard, rigid nature of wear indicating layer 30, sole 7 will still be protected. In addition, if wear indicating layer 30 was to become exposed based on damage to or wearing out of a portion of ground engaging layer 20, the exposure of this hard rigid material will alert the user with immediate visual feedback, thereby enabling the user to take timely action to ensure that sole 7 remains protected, such as by attaching a new protector 10.

As indicated above, the most preferred embodiment of the invention has shoe sole protector 10 produced during production of a given shoe 2 for which protector 10 is designed so as to establish a custom fit. In connection with this embodiment, at least ground engaging layer 20 is preferably formed with an upwardly extending, peripheral rim portion 45 as shown in FIG. 2. As indicated, adhesive layer 15 extends onto peripheral rim portion 45. With this arrangement, when protector 10 is attached to sole 7, peripheral rim portion 45 will extend slightly up and around sole 7. Not only does this arrangement provide aesthetic benefits, but additional protection is assured for edge portions of sole 7. Of course, since sole protector 10 is preferably custom made for each individual shoe 2, protector 10 could actually be upwardly curved about its periphery so as to essentially define a peripheral rim which extends to outside portions of sole 7, such as generally indicated in FIG. 3.

Based on the above, it should be readily apparent that the shoe sole protector of the present invention advantageously enables the owner of a pair of shoes to protect the soles thereof during use, regardless of whether the shoes are collectible or simply overly coveted by the owner. The particular adhesive employed in connection with the sole protector of the present invention can vary. Again, although not shown, the protector can be formed by being traced on a block having the ground engaging, wear indicating and adhesive layers, with or without the conforming layer, followed by the user simply cutting the block into a particular shape in a manner similar to that employed in connection with known shoe inserts. Furthermore, the sole protector, or at least the ground engaging layer, can vary in color to provide, in addition to the protective function, an enhanced style aspect to the invention. In any case, although described with reference to preferred embodiments of the invention, it should be readily understood that various changes and/or modifications can be made to the invention without departing from the spirit thereof. In general, the invention is only intended to be limited by the scope of the following claims.

I claim:

1. A shoe assembly comprising:

a shoe including an upper and a ground engaging sole; and a one-piece protector attached to and covering the sole of the shoe, the protector including:

a ground engaging layer of elastomeric material;

a wear indicating layer made of a flexible plastic which is harder than the elastomeric material of the ground engaging layer, said wear indicating layer being arranged atop the ground engaging layer such that, when exposed, provides a visual alert that the ground engaging layer has been compromised; and an adhesive layer positioned on a side of the wear indicating layer opposite the ground engaging layer, said adhesive layer removably securing the protector to the sole of the shoe;

wherein, the thickness of the protector does not exceed approximately 56 mils.

2. The shoe assembly of claim 1, wherein the protector further comprises a deformable conforming layer positioned between the wear indicating layer and the adhesive layer.

3. The shoe assembly of claim 1, wherein the ground engaging layer includes an upwardly extending peripheral rim portion adapted to adhere to and cover edge portions of the sole of the shoe.

4. The shoe assembly of claim 1, wherein the ground engaging layer including a front portion, an intermediate portion and a rear portion, said ground engaging layer also including traction treads formed on at least said front and rear portions.

5. The shoe assembly of claim 1, wherein the thickness of the protector does not exceed approximately 36 mils.

6. The shoe assembly of claim 1, wherein the thickness of the ground engaging layer is in the range of approximately 19 mils.

7. The shoe assembly of claim 1, wherein the thickness of the wear indicating layer is approximately 4 mils.

8. The shoe assembly of claim 1, wherein the protector is a customized protector which fits contours of the shoe without further modifications.

9. The shoe assembly of claim 1, wherein the protector is adapted to be cut to a desired size and shape by a user.

10. The shoe assembly of claim 1, wherein the protector is magnitudes thinner than the sole and lacks any holes over an entire surface of the sole covered by the protector.

* * * * *